US011742593B2

(12) United States Patent
Hojjat

(10) Patent No.: US 11,742,593 B2
(45) Date of Patent: Aug. 29, 2023

(54) WIDEBAND BISECTOR ANNTENNA ARRAY WITH SECTIONAL SHARING FOR LEFT AND RIGHT BEAMS

(71) Applicant: Communication Components Antenna Inc., Kanata (CA)

(72) Inventor: Nasrin Hojjat, Ottawa (CA)

(73) Assignee: Communication Components Antenna Inc., Kanata (CA)

( * ) Notice: Subject to any disclaimer, the term of this patent is extended or adjusted under 35 U.S.C. 154(b) by 0 days.

(21) Appl. No.: 17/463,973

(22) Filed: Sep. 1, 2021

(65) Prior Publication Data

US 2023/0061703 A1 Mar. 2, 2023

(51) Int. Cl.
*H01Q 21/24* (2006.01)
*H01Q 3/40* (2006.01)

(52) U.S. Cl.
CPC ..... *H01Q 21/24* (2013.01); *H01Q 3/40* (2013.01)

(58) Field of Classification Search
CPC ..... H01Q 21/24; H01Q 3/40
See application file for complete search history.

(56) References Cited

U.S. PATENT DOCUMENTS 6,252,560 B1 * 6/2001 Tanaka ..... H01Q 25/00 342/371
6,608,591 B2 * 8/2003 Wastberg ..... H01Q 21/065 342/373
6,788,258 B2 * 9/2004 Olson ..... H01Q 9/0428 343/815
2009/0146904 A1 * 6/2009 Shi ..... H01Q 23/00 343/893
2019/0273315 A1 * 9/2019 Hu ..... H01Q 21/0006
2019/0349050 A1 * 11/2019 Lou ..... H04B 1/40
2021/0250780 A1 * 8/2021 Wu ..... H01Q 19/106
2022/0116790 A1 * 4/2022 Firouzbakht ..... H01Q 5/307
2022/0166129 A1 * 5/2022 Tang ..... H01Q 21/28

FOREIGN PATENT DOCUMENTS

CN 208507973 U * 2/2019
CN WO-2022051986 A1 * 3/2022
EP WO-2022033688 A1 * 2/2022

* cited by examiner

*Primary Examiner* — Ab Salam Alkassim, Jr.
*Assistant Examiner* — Anh N Ho
(74) *Attorney, Agent, or Firm* — Sofer & Haroun, LLP

(57) ABSTRACT

A wideband bisector antenna has a plurality of antenna elements disposed in horizontal rows, a left beam bi-sector array segment at one section of the antenna comprising a plurality of the horizontal rows of elements, and a right beam bi-sector array segment at one section of the antenna comprising a plurality of the horizontal rows of elements. At least one horizontal row on the antenna is shared in both the left beam bi-sector array segment and the right beam bi-sector array segment.

11 Claims, 13 Drawing Sheets

WIDEBAND BISECTOR ANNTENNA ARRAY WITH SECTIONAL SHARING FOR LEFT AND RIGHT BEAMS

FILED OF THE INVENTION

This application relates to wideband bisector array antennas. More particularly, the present application relates to a wideband bisector array antenna with sectional sharing between left beam and right beam arrays to provide a trade-off between gain and co-polar isolation.

DESCRIPTION OF RELATED ART

Co-polar isolation in wideband bisector array antennas refers to the isolation between left and right sector ports in bisector arrays.

In the field of base station antennas, a bisector array is an array that produces two 33 deg beams toward left and right of the boresight direction. See for example U.S. Pat. No. 8,311,582. The term "wideband" can have different interpretations but usually refers to an antenna with greater than 40% beamwidth with the definition of beamwidth being (BW=% (f2−f1)/f0, f2 end of band, f1 band start, f0 mid band). When an antenna is wideband, traditional narrowband approaches cannot be used to improve co-polar isolation throughout the full band.

In the prior art to produce asymmetrical bisector arrays with two offset asymmetrical beams, two different approaches have been used. One approach shown in prior art FIG. 1A is taken for example from Canadian Patent Application No. 3,059,076 uses a single array of patch elements and use an azimuth beamformer with two input ports one for left and one for right beams. These beamformers are usually based on variations of the Butler matrix concept shown in FIG. 1B. (#1-#10 in FIG. 1B simply represent basic components of prior art Butler Matrix, with #1 and #2 representing inputs, #3-#6 representing outputs, and with 100 ohm resisters positioned between points #7 and #8 and between #9 and #10) In such arrays when one of the beam ports (for example left beam) is excited, due to non-ideal isolation within the beamformer, non-ideal return loss of elements, and coupling between array columns, part of the power is coupled to the other beam port (for example right beam) and causes low values of co-polar isolation. The lower values of the co-polar isolation are usually worse at smaller electrical down tilt in which reflected signal from elements are in more phase and add to each other (i.e. worst at 0 deg tilt when all array elements are in phase and can be as low as 11 dB to 12 dB in some part of the band). These low values of co-polar isolation can cause return loss issues for transmitter and may results in VSWR alarms in transmitter units.

There have been some co-polar isolation improvement approaches for narrow band arrays to optimize co-polar isolation, for example using fences around the elements, or optimizing the azimuth beamformer. However, these approaches are not able to reduce the isolation in a wideband array with more than 40% beamwidth.

Another prior art approach shown in FIG. 2, is to have two independent arrays (stacked over each other) in which each array produces one 33 deg BW offset beam. The side-by-side arrays for both the top and bottom (left and right) are for providing 4*4 MIMO for each beam. One of the arrays (for example bottom array) produces a beam toward right for example with an offset of +25 deg and the other array (for example top array) produces a beam toward left usually with same offset. In such a top and bottom configuration of FIG. 2, the isolation between the antenna ports for left and right beams, called co-polar isolation, is ideal as the array consists of two independent arrays. For example, the value is >30 dB and more. This approach though providing ideal isolation, needs available vertical space for two independent vertically stacked arrays to provide the required gain.

In this context, high co-polar isolation is desirable between the left and right beam ports in a wideband bisector arrays antenna. However, there are physical and signal quality limitations. For example, co-polar isolation is required but the antenna must maintain reasonable physical height and signal gain characteristics. For example, the approach of FIG. 2 provides good isolation between the left and right beams and is suitable for long (vertical) arrays where space was available for such stacking electrically left and right beams. However, for antenna arrays with stricter vertical height constraints, such stacking approach is not possible.

OBJECTS AND SUMMARY

The present arrangement looks to solve this issue by not only increasing co-polar isolation between the bisector arrays by vertically separating them on the antenna, but also reduces the vertical height of such an arrangement by having the left beam feed network and the right beam network share at least one common horizontal row of elements.

To this end a wideband bisector antenna has a plurality of antenna elements disposed in horizontal rows, a left beam bi-sector array segment at one section of the antenna comprising a plurality of the horizontal rows of elements, and a right beam bi-sector array segment at one section of the antenna comprising a plurality of the horizontal rows of elements. At least one horizontal row on the antenna is shared in both the left beam bi-sector array segment and the right beam bi-sector array segment.

BRIEF DESCRIPTION OF THE DRAWINGS

The present invention can be best understood through the following description and accompanying drawing, wherein.

DETAILED DESCRIPTION

Figure 3:
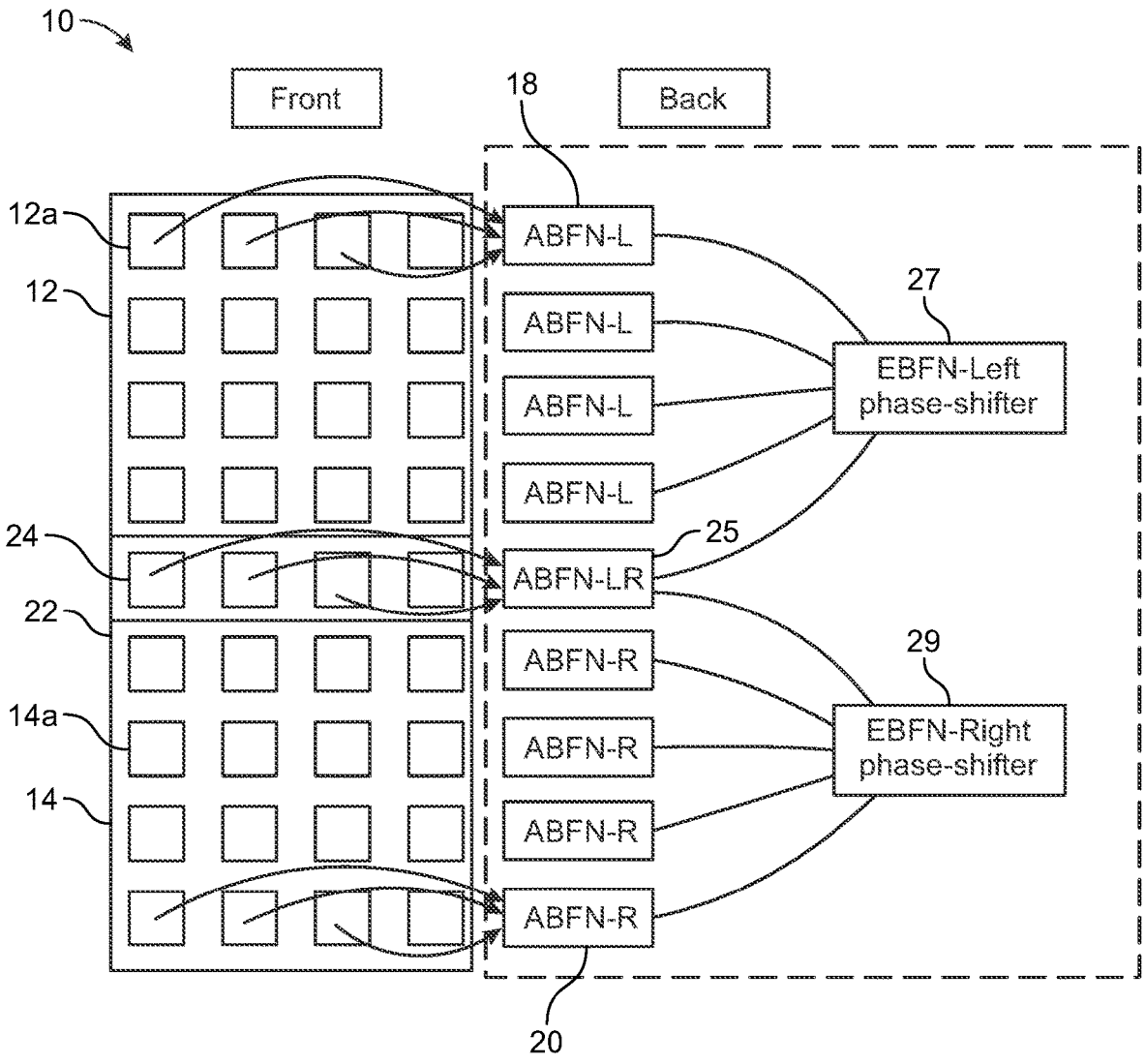
FIG. 3 shows a wideband bisector array antenna and beamforming network using a single array for both left and right beams, where a segment of the elements is used for both the left and right beam, in accordance with one embodiment.

In one embodiment as shown in FIG. 3 a wideband bisector antenna 10 is shown having a left beam bi-sector array segment 12 at the top of antenna 10 and a right beam bisector array segment 14 at the bottom of antenna 10. Each of left array segment 12 and right array segment 14 include a plurality of radiating elements 12*a* and 14*a* respectively. Such radiating elements 12*a* and 14*a* may be patch elements or dipole elements or combinations thereof depending on the frequency range for antenna 10. Elements 12*a* of left beam array segment 12 are fed from left asymmetric (azimuth) beam forming networks 18 and elements 14*a* of right beam array segment 14 are fed from right asymmetric (azimuth) right beam forming networks 20.

As shown in FIG. 3 at least one shared horizontal row 22 is located between upper left beam array 12 and lower right beam array 14 and forms a shared row of elements 24 connected to joint left and right asymmetric (azimuth) beamforming network 25. The beam ports of the left and right beam forming networks 18 and 20 as well as joint left/right asymmetric (azimuth) beamforming network 25 are independent and can each have proper phase for elevation for common row of elements 24. Each of ABFN 18, 20 and 25 are coupled to their respective elevation beam forming network (Phase shifter 27/29) as shown in FIG. 3.

Figures 3A, 3B, 3C:
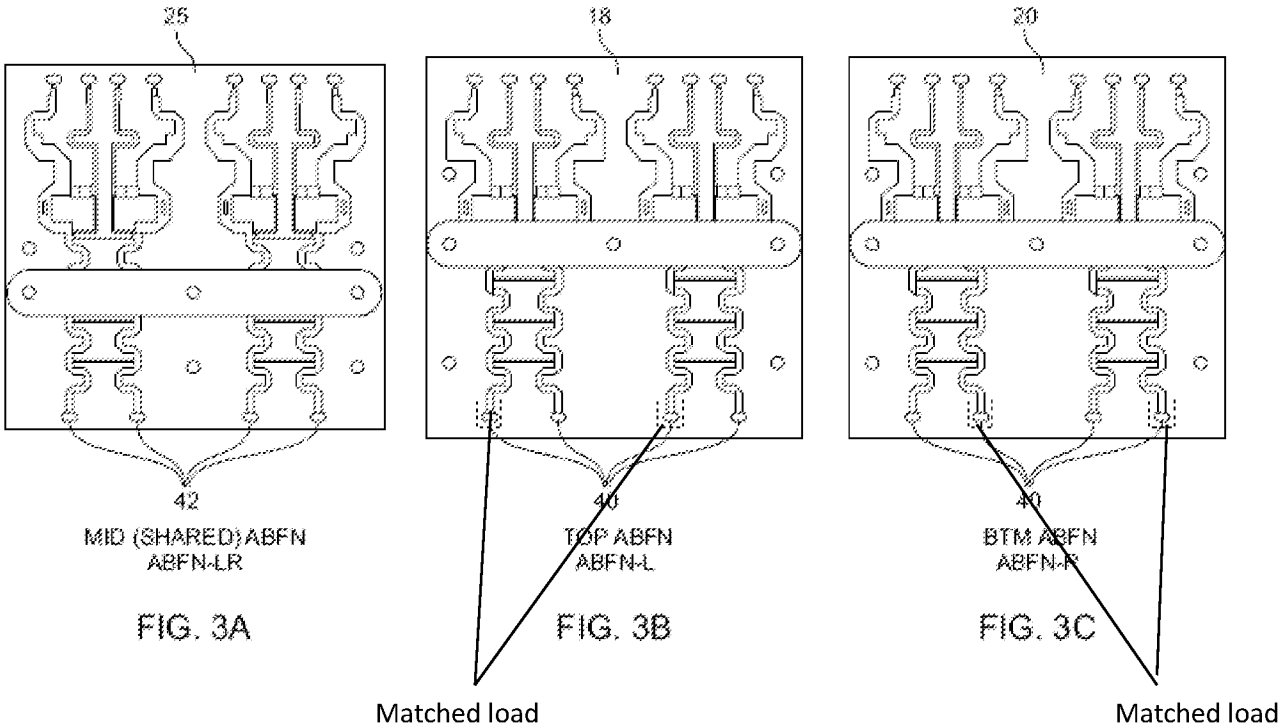
FIGS. 3A-3C show three asymmetric beam forming networks for the shared row (left/right beam), left beam and right beam rows respectively in accordance with one embodiment.

FIGS. 3A-3C show each of ABFNs 18, 20 and 25. To have proper phasing between array rows and to keep the asymmetrical shape, Butler Matrix azimuth beamformers 18, 20 and 25 are used for all beam forming networks, where beamformer 18 feeds the elements 12*a* of left array segment 12, and beamformer 20 feeds the elements 14*a* of right array segment 14. As further shown in FIGS. 3B and 3C, inputs 40 of beamformer 18 is connected to left beam phase shifters (+45, −45 polarization) 27 and inputs 40 of beamformer 20 is connected to right beam phase shifters (+45, −45 polarization)29. As such matched loads are used on right inputs of each of azimuth beamformers 18 for independent left rows of elements 12 and matched loads are used on left inputs each of azimuth beamformers 20 for independent right rows of elements 14. For shared row 22 both input ports 42 of the azimuth beamformers 25 are connected to phase shifters 27/29. As only part of antenna 10 is using common beamformer connections for shared row 20, co-polar isolation is improved compared to normal Butler BSA.

Such an arrangement as shown in FIG. 3 is intended to be exemplary to understand the basic concept of at least one shared row of elements 20 that excites for both the left and right beam, and thus acts as part of the left array segment 12 and right array segment 14. Various permutations of this concept are explained in more detail below, illustrating additional exemplary embodiments and examples of specific antenna implementations.

Figure 4:
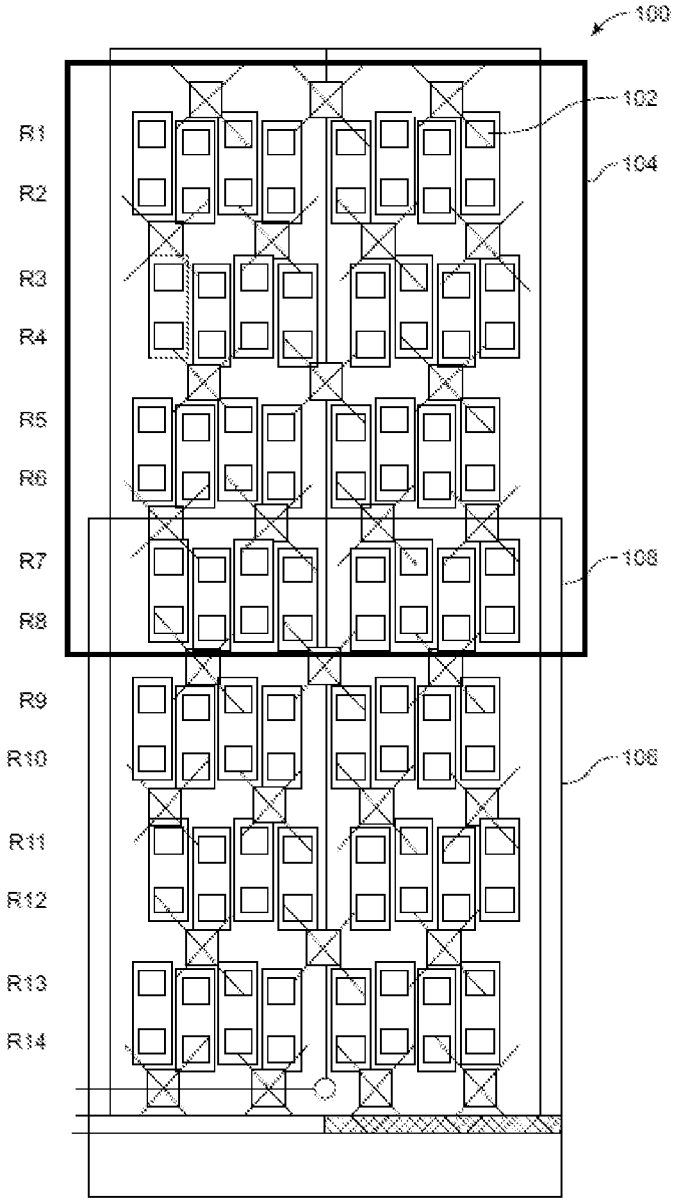
FIG. 4 shows a wideband bisector array antenna for both left and right beams, where a segment of the elements is used for both the left and right beam in accordance with one embodiment.

In one embodiment FIG. 4 shows an exemplary embodiment of a wideband bisector antenna 100. Antenna 100 has fourteen rows of patch elements 102 (labeled r1-r14). In this embodiment, each row of elements 102 includes eight elements 102 for a total of one hundred and twelve patch elements 102. Additional dipole elements may be added to array 100 (and the remaining embodiments), but such dipole elements are for additional low band signals that is not related to the sharing concept discussed herein. The use of eight elements 102 in each row is for providing two left beams and two right beams for 4*4MIMO application. Antenna 100 has a left beam array segment 104 at the top and a right beam array segment 106 at the bottom. As illustrated in FIG. 4, left beam array segment 104 includes the top eight rows of elements 102 (r1-r8), and right beam array segment 106 includes the bottom eight rows of elements 102 (r7-r14). In brief this architecture can be called "SS882", which means there are two eight row arrays which are sharing 2 rows.

As shown in FIG. 4 there is a middle segment 108 (r7 and r8) where the elements 102 of such segment are shared between left beam array segment 104 and right beam segment 106, with such elements 102 in those rows being excited by both the associated left and right beam forming networks. The arrangement in FIG. 4 is sharing only 0.25 of array 100, so this is an example that tradeoff is more towards having better co-polar isolation than higher gain.

Figure 5:
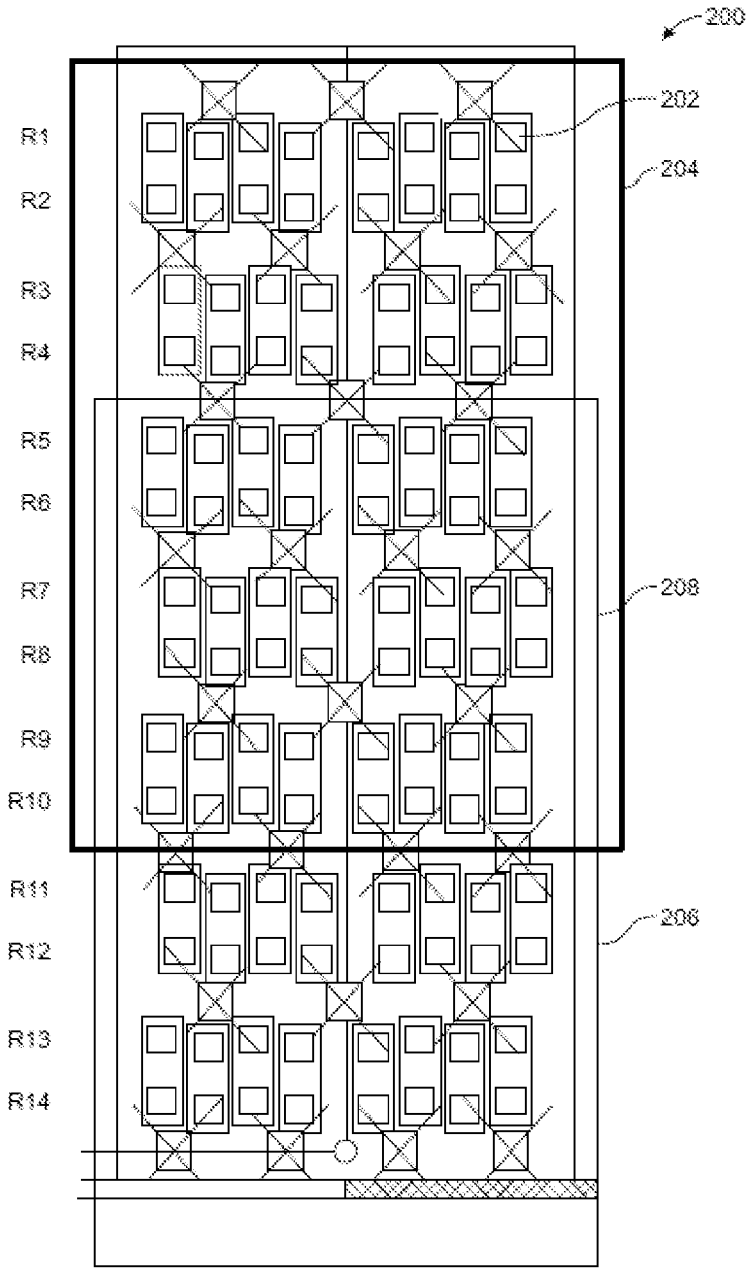
FIG. 5 shows another wideband bisector array antenna for both left and right beams, where a segment of the elements is used for both the left and right beam in accordance with one embodiment.

In one embodiment FIG. 5 shows another exemplary embodiment of a wideband bisector antenna 200. Antenna 200 like antenna 100 has fourteen rows of patch elements 202 (labeled r1-r14). In this embodiment, each row of elements 202 includes eight elements 202 for a total of one hundred and twelve patch elements 202, again to provide 4T4R for each beam. Antenna 200 has a left beam array segment 204 at the top and a right beam array segment 206 at the bottom. As illustrated in FIG. 5, left beam array segment 204 includes the top ten rows of elements 202 (r1-r10), and right beam array segment 206 includes the bottom ten rows of elements 202 (r5-r14). This may be referred to as "5510106" architecture with 4*4 MIMO per beam.

As shown in FIG. 5 there is a middle segment 208 (r5-r10) where the elements 202 of such segment are shared between left beam array segment 204 and right beam segment 206, with such elements 202 in those rows being excited by both the associated left and right beam forming networks. The arrangement in FIG. 5 is sharing 0.6 of array 200, so it is an example that the tradeoff is more toward having better gain than co-polar isolation.

Figure 6:
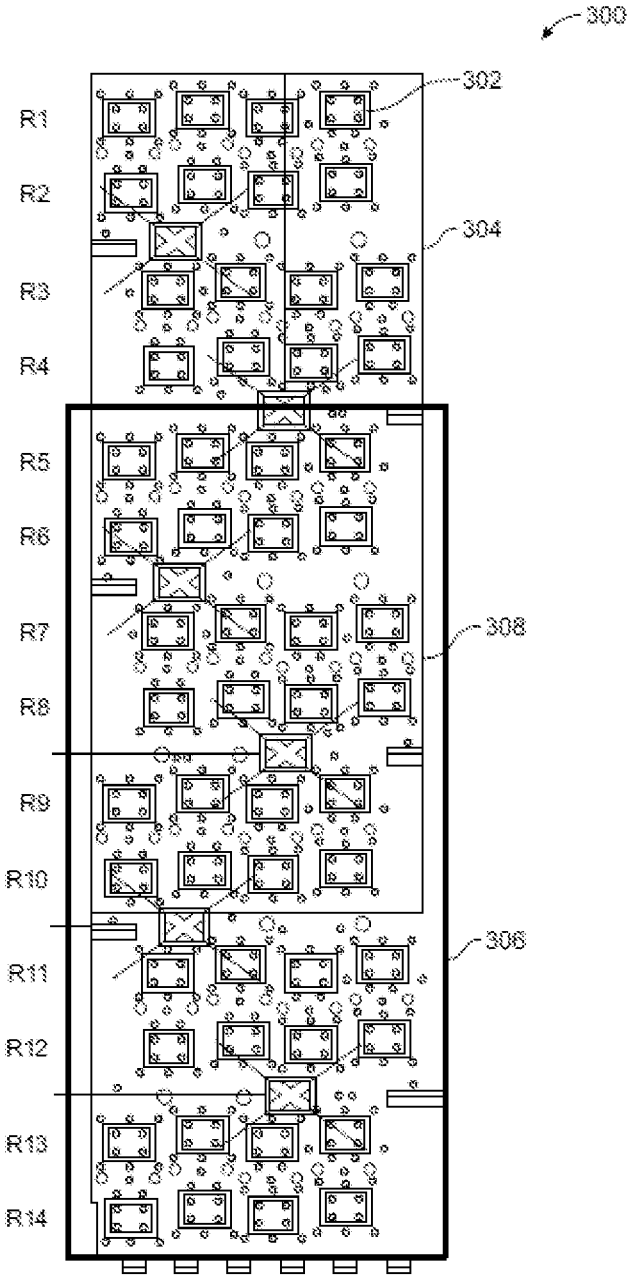
FIG. 6 shows another wideband bisector array antenna for both left and right beams, where a segment of the elements is used for both the left and right beam in accordance with one embodiment.

In one embodiment FIG. 6 shows another exemplary embodiment of a wideband bisector antenna 300. Antenna 300 has fourteen rows of patch elements 302 (labeled r1-r14). In this embodiment, each row of elements 302 includes four elements 302 for a total of fifty-six patch elements 302. Antenna 300 has a left beam array segment 304 at the top and a right beam array segment 306 at the bottom. As illustrated in FIG. 6, left beam array segment 304 includes the top ten rows of elements 302 (r1-r10), and right beam array segment 306 includes the bottom ten rows of elements 302 (r5-r14) and be named "SS10106" for 2*2 MIMO per beam (no side-by-side).

As shown in FIG. 6 there is a middle segment 308 (r5-r10) where the elements 302 of such segment are shared between left beam array segment 304 and right beam segment 306, with such elements 302 in those rows being excited by both the associated left and right beam forming networks. This arrangement in FIG. 6 is directed to the concept of the patent in a narrower 2*2 MIMO so we can apply it later to 4*4 MIMO. The results discussed below in FIGS. 7, 8, 9, and 10 are taken from this test arrangement.

Figure 1A:
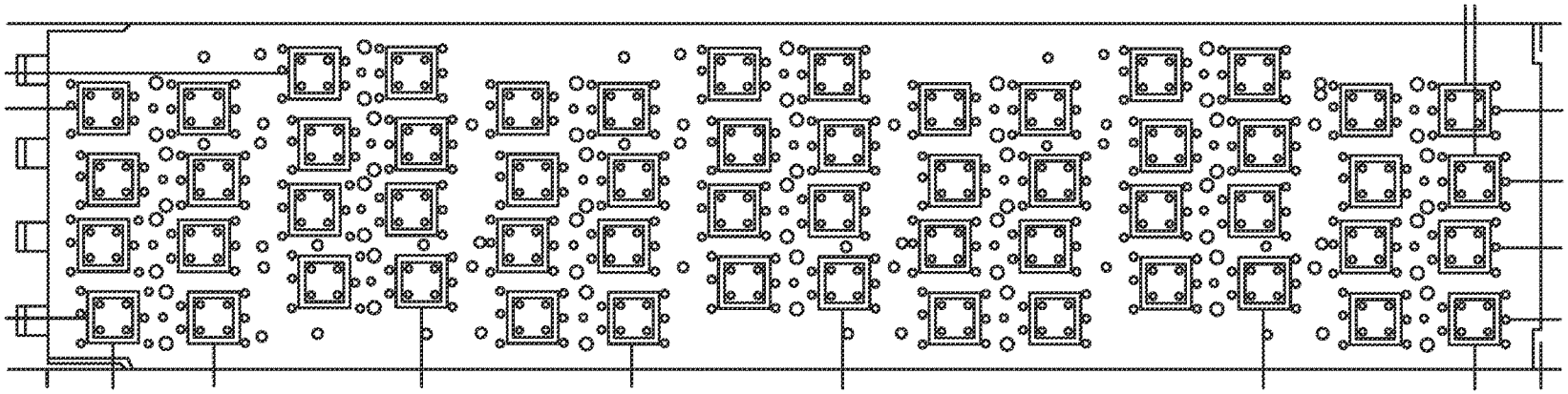
FIG. 1A (PRIOR ART)
FIGS. 1A and 1B show a prior art arrangement wideband bisector array antenna using a single array for left and right beams fed using a Butler type beamforming network.
Figure 1B:
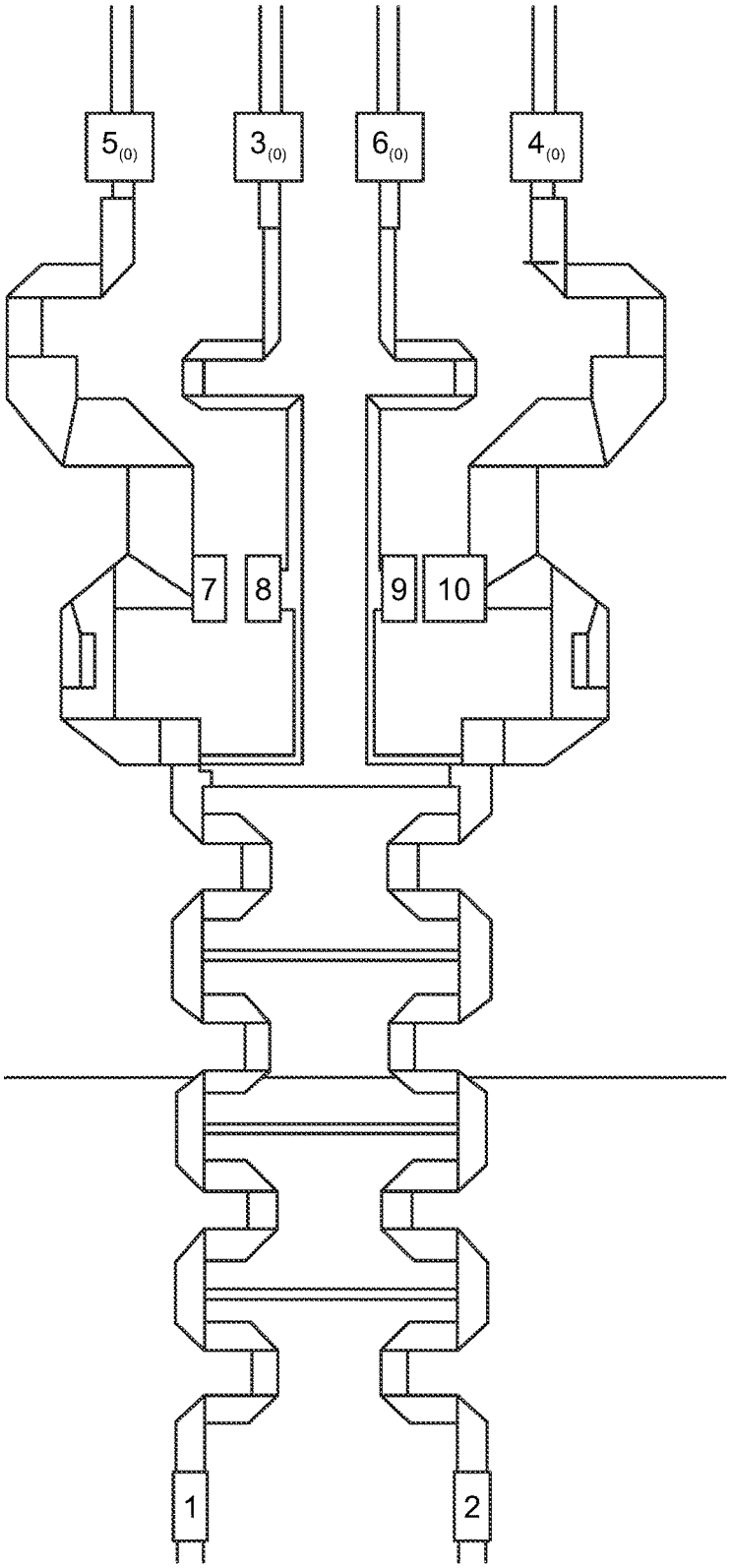
FIG. 1B (PRIOR ART)
Figure 2:
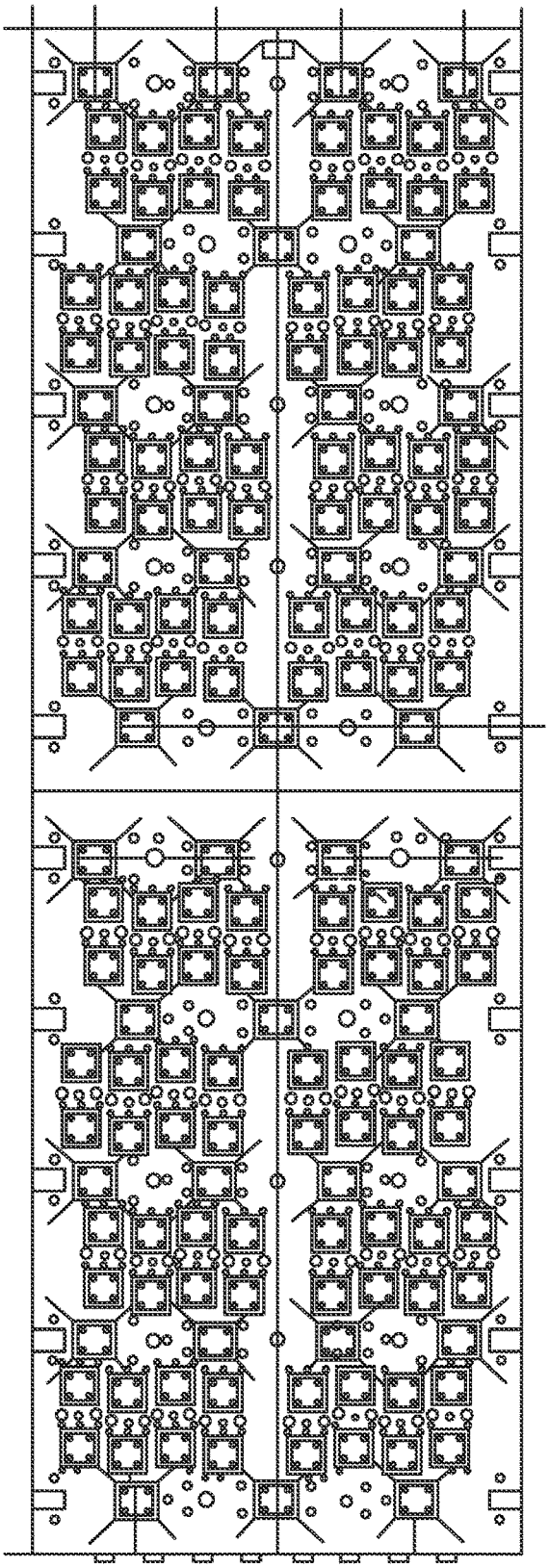
FIG. 2 (PRIOR ART)
FIG. 2 shows a prior art arrangement for wideband bisector array antennas with two separate arrays one for the left beam and one for the right beam.
Figure 7:
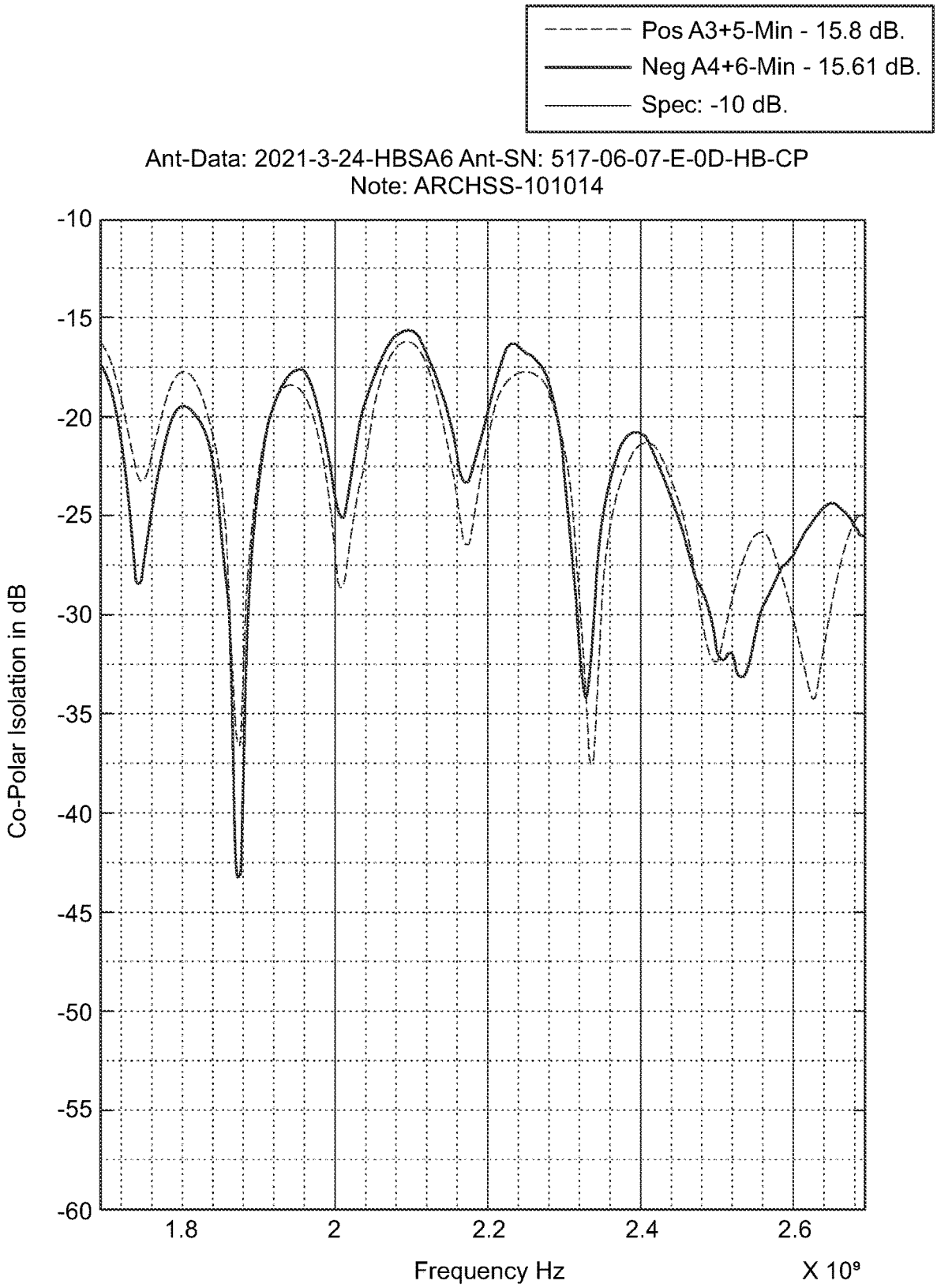
FIG. 7 is a co-polar isolation graph of the antenna of FIG. 6
Figure 8:
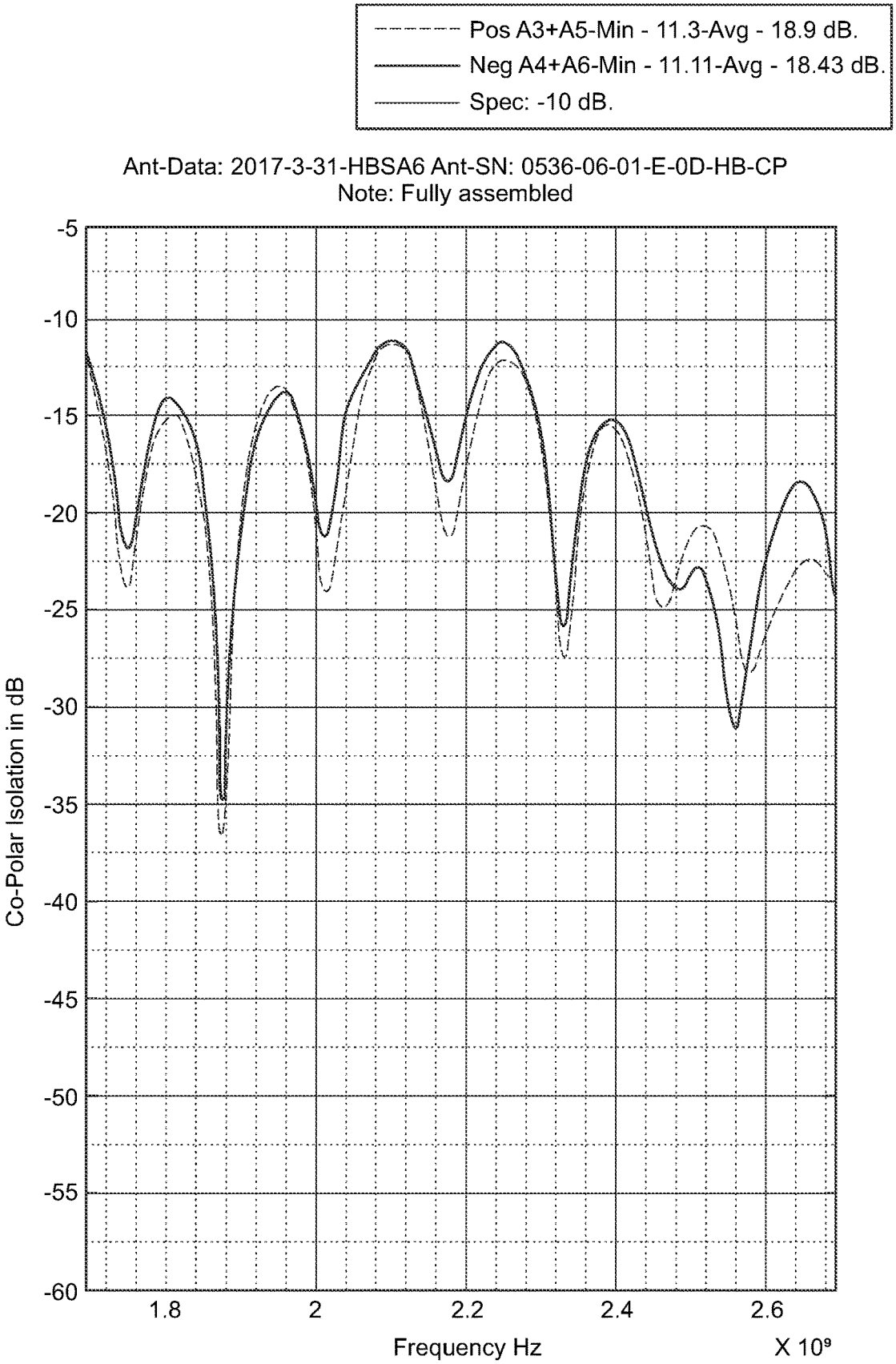
FIG. 8 shows is a co-polar isolation graph of the antenna of FIG. 1A.

As shown in FIGS. 7 and 8 these graphs shows left and right port isolation in order to demonstrate the effectiveness of the improvement in co-polar isolation in one of the embodiments such as that shown in FIG. 6, two tests were run, one with the exact arrangement as described above with six shared rows in middle segment 308 (FIG. 7) and one with standard approach as FIG. 1A using a common Butler for all rows (FIG. 8). As can be see having partial sharing rather full sharing can improve co-polar isolation by 5 dB for 60% sharing.

Figure 9A:
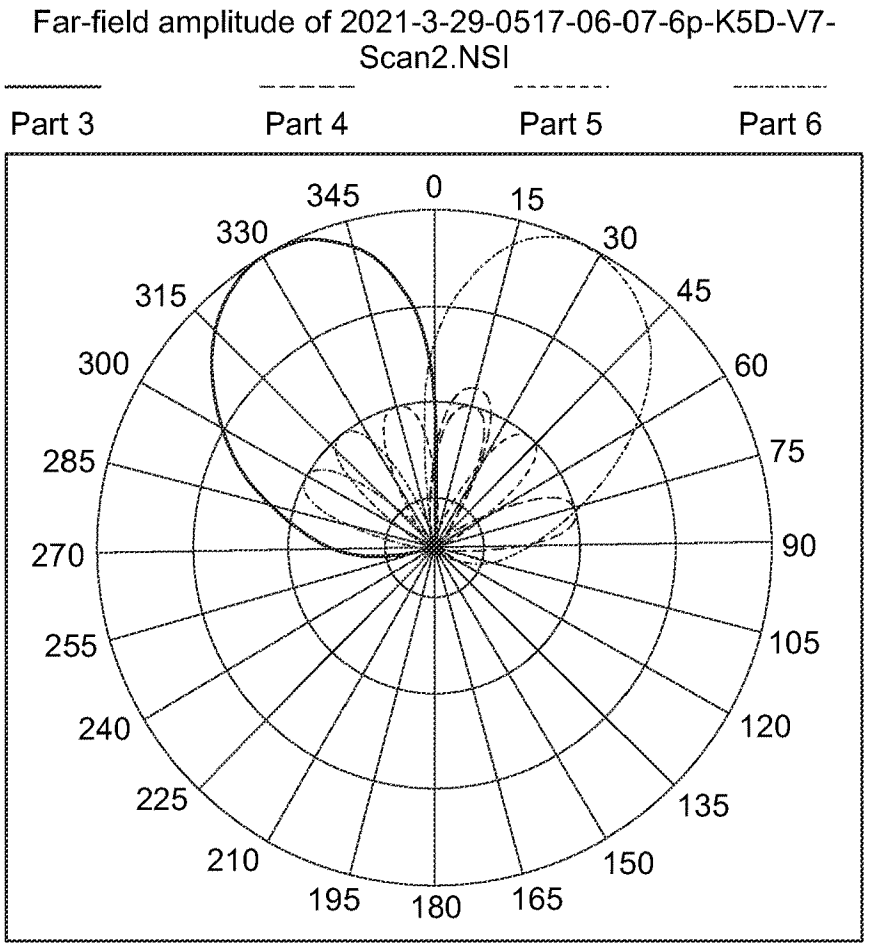
FIGS. 9*a* and 9B show azimuth and elevation patterns for a wideband bisector array antenna for both left and right beams, where a segment of the elements is used for both the left and right beam in accordance with one embodiment.
Figure 9B:
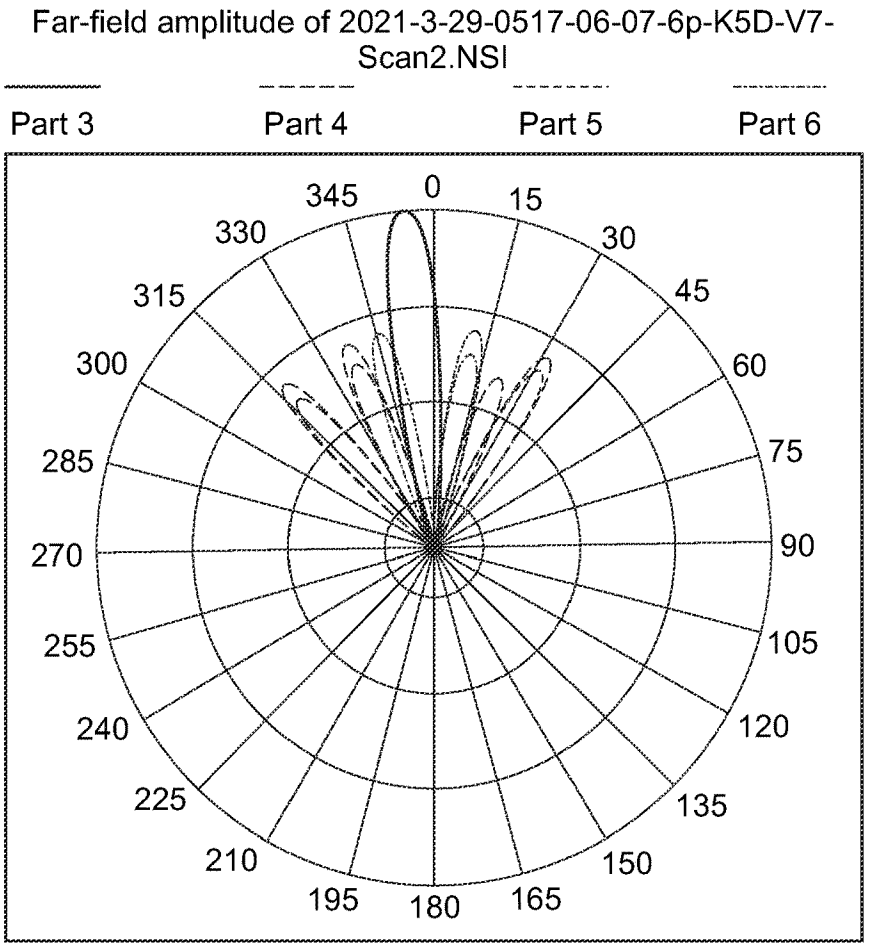
Figure 10A:
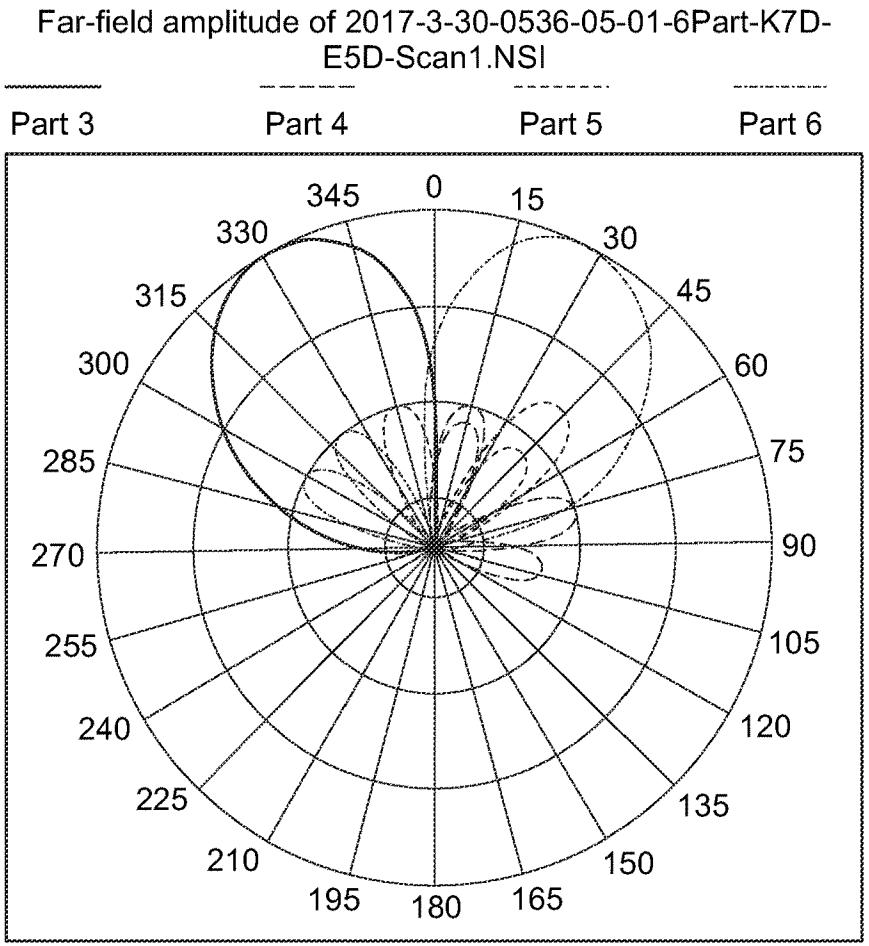
FIGS. 10*a* and 10*b* show azimuth and elevation patterns for a wideband bisector array antenna for both left and right beams, in accordance with prior art FIG. 1A.
Figure 10B:
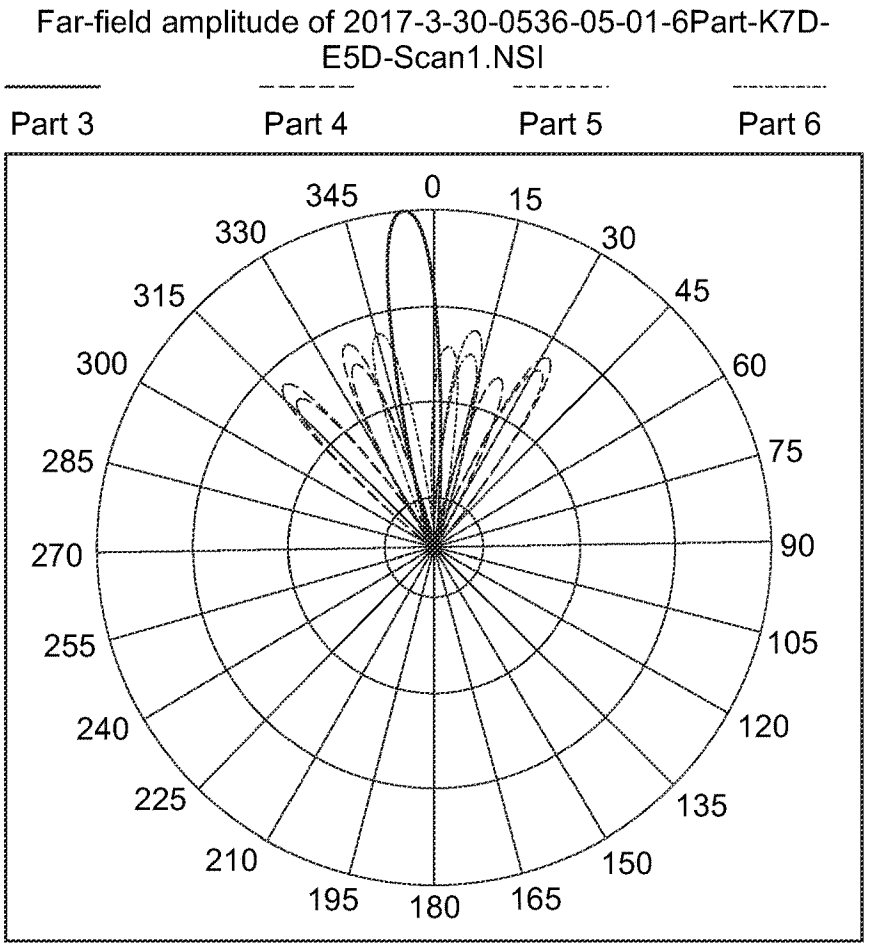

FIGS. 9*a* and 9*b* show an azimuth-elevation pattern for antenna for antenna 300 from FIG. 6 compared to the azimuth-elevation pattern for prior art arrangement of FIG. 1A as shown in FIGS. 10*a* and 10*b*. FIGS. 9*a* and 9*b* demonstrate that the azimuth-elevation pattern for the present arrangement, with partially shared rows of elements does not negatively impact the azimuth-elevation pattern relative to the prior art. Yet, as demonstrated above in FIG. 7 there is improved co-polar isolation relative to the prior art shown in FIG. 8.

Figure 11:
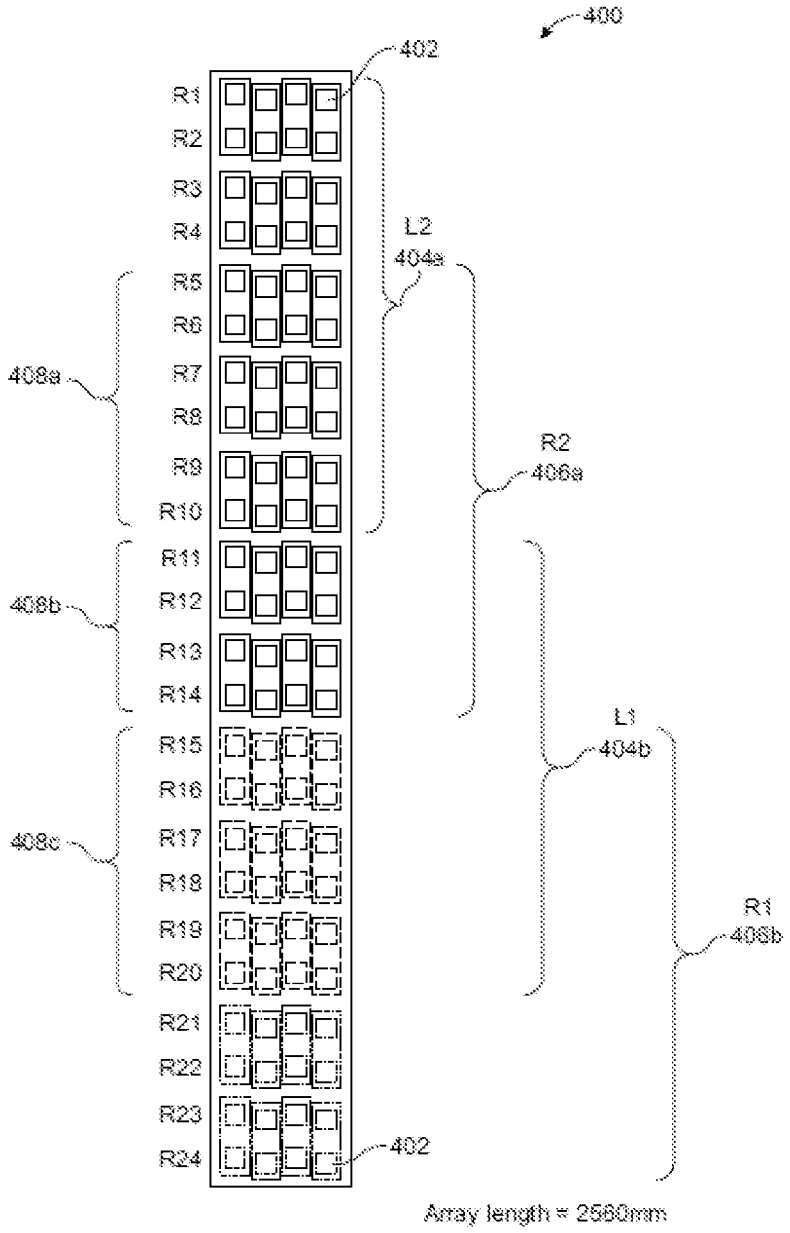
FIG. 11 illustrates a narrow width 4*4 MIMO wideband bisector antenna 400 for both left and right beams, where segments of the elements are used for both the left and right beams between different arrays in accordance with one embodiment.

It is noted that the above arrangement of sharing certain rows of elements for both the left and right beam of a wideband bisector antenna may also be employed in similar arrangements such as a multi-wideband bisector antenna 400 with multi-sectoral sharing as shown in FIG. 11. This antenna 400 should provide 4T4R (4*4 MIMO) for each left and right beam however due to width of antenna 400, all the arrays are stacked vertically. In prior art, there would be two arrays stacked over each other each produce two beams with low co-polar isolation. In this new architecture there are four arrays with each of them having some sectoral sharing with its neighboring arrays.

In FIG. 11 an exemplary embodiment of multi-wideband bisector antenna 400 is shown. Antenna 400 has twenty four rows of patch elements 402 (labeled r1-r24). In this embodiment, each row of elements 402 includes four elements 402 for a total of ninety-six patch elements 402. Antenna 400 has a first left beam array segment 404*a* at the top and a first right beam array segment 406*a* below left beam segment 404*a*. As illustrated in FIG. 11, first left beam array segment 404*a* includes the top ten rows of elements 402 (r1-r10), and first right beam array segment 406*a* includes the ten rows of elements 402 (r5-r14).

As shown in FIG. 11 there is a first overlap segment 408*a* (r5-r10) where the elements 402 of such segment are shared between first left beam array segment 404*a* and first right beam segment 406*a*, with such elements 402 in those rows being excited by both the associated left and right beam forming networks.

Below first right beam segment 406*a* a second left beam segment 404*b* is arranged. As illustrated in FIG. 11, second left beam array segment 404*b* includes the ten rows of elements 402 (r11-r20). A subsequent second right beam array segment 406*b* includes the ten rows of elements 402 (r15-r24).

As shown in FIG. 11 there is a second overlap segment 408*b* (r11-r14) where the elements 402 of such segment are shared between second left beam array segment 404*b* and first right beam segment 406*a*, with such elements 402 in those rows being excited by both the associated left and right beam forming networks. Moreover, there is third overlap segment 408*c* (r15-r20) where the elements 402 of such segment are shared between second left beam array segment 404*b* and second right beam segment 406*b*, with such elements 402 in those rows being excited by both the associated left and right beam forming networks. The antenna in FIG. 11 compared to prior art provides better co-polar isolation by sharing 67% of the array instead of full sharing, while the height increase is only 17% and the array length stays in an acceptable range of <2.7 m.

What is claimed is:

1. A wideband bi-sector antenna comprising:

a plurality of antenna elements disposed in horizontal rows, said horizontal rows stacked over one another along a vertical axis of the antenna;

a left beam bi-sector array segment at either an upper or a lower section of said antenna comprising a plurality of said horizontal rows of said plurality of antenna elements;

a right beam bi-sector array segment at another of said either upper or lower section of said antenna comprising a plurality of said horizontal rows of said plurality of antenna elements;

wherein at least one horizontal row on said antenna is shared in a middle of said antenna along the vertical axis thereof, in both said left beam bi-sector array segment and said right beam bi-sector array segment, wherein said plurality of antenna elements of said left beam bi-sector array segment are fed by left asymmetric (azimuth) beam forming networks and wherein said plurality of antenna elements of said right beam bi-sector array segment are fed by right asymmetric (azimuth) beam forming networks.

2. The antenna as claimed in claim 1, wherein said shared horizontal row or rows of said plurality of antenna elements is located between said left and right beam bi-sector array segments.

3. The antenna as claimed in claim 1, wherein said left beam bi-sector array segment comprising said plurality of said horizontal rows of said plurality of antenna elements; and said right beam bi-sector array segment comprising a plurality of said horizontal rows of said plurality of antenna elements both constitute at least one vertical column of said elements, wherein along any one of said at least one vertical column, at least one of said plurality of antenna elements in said left beam bi-sector array segment, at least one of said plurality of antenna elements is in right beam bi-sector array segment, and at least one of said plurality of antenna elements is shared in both said right beam bi-sector array segment and said left beam bi-sector array segment.

4. The antenna as claimed in claim 1, wherein said at least one horizontal row on said antenna that is shared in both said left beam bi-sector array segment and said right beam bi-sector array segment is fed by a joint left and right asymmetric (azimuth) beamforming network.

5. The antenna as claimed in claim 1, wherein said plurality of antenna elements of said left beam bi-sector array segment and said left asymmetric (azimuth) beam forming networks are connected to a left elevation beam forming network (phase shifter) and said plurality of antenna elements of said right beam bi-sector array segment and said right asymmetric (azimuth) beam forming networks are connected to a right elevation beam forming network (phase shifter).

6. The antenna as claimed in claim 4, wherein said at least one horizontal row on said antenna that is shared in both said left beam bi-sector array segment and said right beam bi-sector array segment is fed by a joint left and right asymmetric (azimuth) beamforming network is coupled to both a left elevation beam forming network (phase shifter) and right elevation beam forming network (phase shifter).

7. The antenna as claimed in claim 5, wherein said left asymmetric (azimuth) beam forming networks use matched loads on right inputs for said plurality of antenna elements of said left beam bi-sector array segment.

8. The antenna as claimed in claim 5, wherein said right asymmetric (azimuth) beam forming networks use matched loads on left inputs for said plurality of antenna elements of said right beam bi-sector array segment.

9. The antenna as claimed in claim 6, wherein said joint left and right asymmetric (azimuth) beamforming network, for said at least one horizontal row on said antenna that is shared in both said left beam bi-sector array segment and said right beam bi-sector array segment, has both of its input ports connected to said left elevation beam forming network (phase shifter) and said right elevation beam forming network (phase shifter).

10. A wideband bi-sector antenna comprising:

a plurality of antenna elements disposed in horizontal rows, said horizontal rows stacked over one another a long a vertical axis of the antenna;

a first left beam bi-sector array segment at an upper or a lower section of said antenna comprising a plurality of said horizontal rows of said plurality of antenna elements;

a right beam bi-sector array segment at a middle section of said antenna comprising a plurality of said horizontal rows of said plurality of antenna elements;

a second left beam bi-sector array segment at another of said either upper or lower section of said antenna comprising a plurality of said horizontal rows of said plurality of antenna elements;

wherein at least one first horizontal row on said antenna is shared in a middle of said antenna a long the vertical axis thereof, in both said first left beam bi-sector array segment and said right beam bi-sector array segment and wherein at least one second horizontal row on said antenna is shared in a middle of said antenna a long the vertical axis thereof, in both said second left beam bi-sector array segment and said right beam bi-sector array segment.

11. The antenna as claimed in claim 10, wherein said right beam bi-sector array segment at said middle one section of said antenna comprising a plurality of said horizontal rows of said plurality of antenna elements is located between said first left beam bi-sector array segment at said either upper or lower section of said antenna comprising a plurality of said horizontal rows of said plurality of antenna elements and said second left beam bi-sector array segment at another of said upper or lower section of said antenna comprising a plurality of said horizontal rows of said plurality of antenna elements.

* * * * *